US007124721B2

(12) United States Patent
Lechner

(10) Patent No.: US 7,124,721 B2
(45) Date of Patent: Oct. 24, 2006

(54) CONTROL DEVICE FOR A GAS EXCHANGE VALVE IN AN INTERNAL COMBUSTION ENGINE

(75) Inventor: Martin Lechner, Lindlar/Frielingsdorf (DE)

(73) Assignee: Mahle Ventiltrieb GmbH, Stuttgart (DE)

( * ) Notice: Subject to any disclaimer, the term of this patent is extended or adjusted under 35 U.S.C. 154(b) by 321 days.

(21) Appl. No.: 10/490,672

(22) PCT Filed: Feb. 13, 2003

(86) PCT No.: PCT/DE03/00421

§ 371 (c)(1),
(2), (4) Date: Mar. 24, 2004

(87) PCT Pub. No.: WO03/071100

PCT Pub. Date: Aug. 28, 2003

(65) Prior Publication Data

US 2004/0244743 A1 Dec. 9, 2004

(30) Foreign Application Priority Data

Feb. 16, 2002 (DE) ..... 102 06 465

(51) Int. Cl.
*F01L 1/34* (2006.01)

(52) U.S. Cl. ..... 123/90.16; 123/90.15; 123/90.22; 123/90.2; 123/193.5

(58) Field of Classification Search ..... 123/90.16
See application file for complete search history.

(56) References Cited

U.S. PATENT DOCUMENTS 4,572,118 A 2/1986 Baguena
5,373,818 A 12/1994 Unger
6,098,580 A * 8/2000 Goto et al. ..... 123/90.17
7,040,267 B1 * 5/2006 Duesmann ..... 123/90.2

FOREIGN PATENT DOCUMENTS

DE 23 35 632 1/1975

(Continued)

*Primary Examiner*—Thomas Denion
*Assistant Examiner*—Kyle M. Riddle
(74) *Attorney, Agent, or Firm*—Collard & Roe, P.C.

(57) ABSTRACT

A control device for a gas exchange valve of an internal combustion engine having a multi-membered transmission comprising at least one driving element (1), actuating elements (2) each of which actuates one gas exchange valve (3), a transmission element (9) which is hinge-connected between the at least one driving element (1) and an actuating element (2) which acts on a gas exchange valve (3), a cam joint (15) between the transmission elements (9) and an area of the housing (5) of the control device, in which a first bearing area which is provided on the transmission element (9) and a second bearing area which is provided in the housing area are adjustable with respect to one another during operation of the engine, is to be manufacturable easily for extremely accurate operation.

Figure 1:
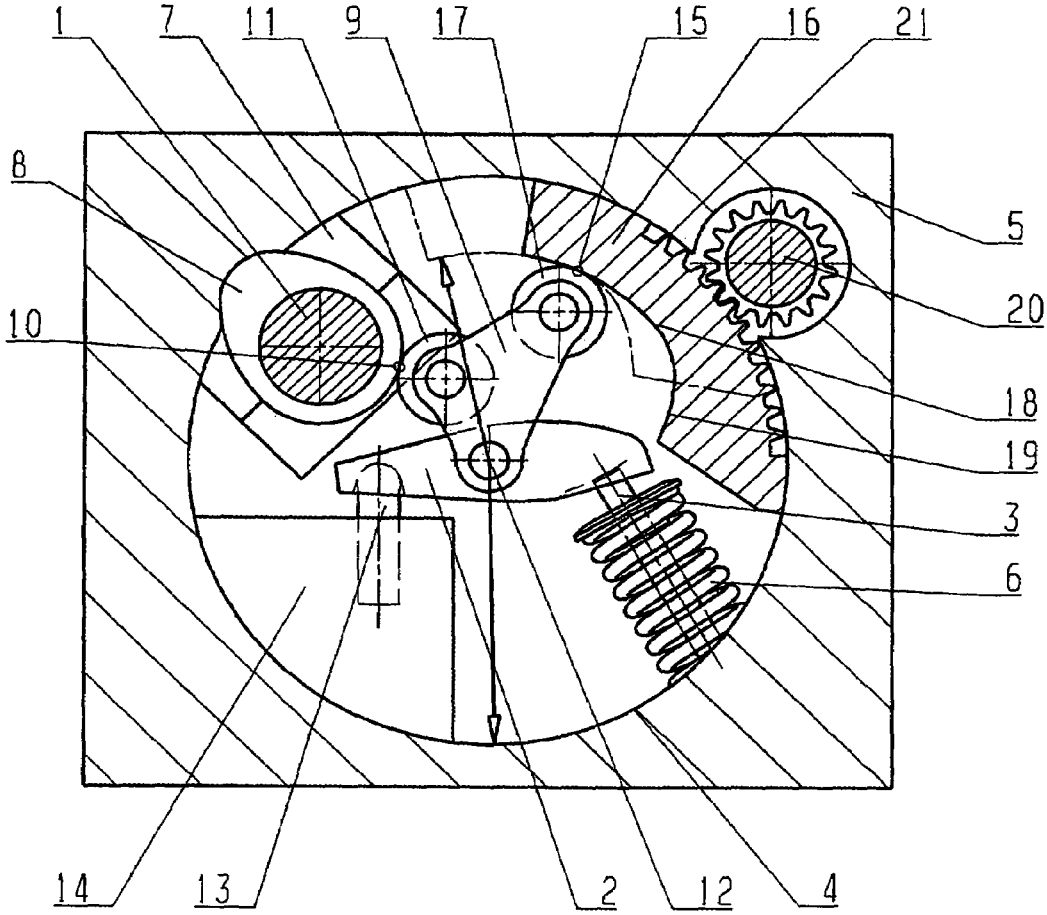

To this end, such a control device is characterized in that the second bearing area of the cam joint (15) forms the radial inside surface of a circular arc-shaped link element which is supported so that it is diplaceable in the direction of the circular arc with a circular cylindrical peripheral surface on the outside radially in a complementary guide surface of the house of the control device.

4 Claims, 3 Drawing Sheets

FOREIGN PATENT DOCUMENTS

| | | |
|---|---|---|
| DE | 38 33 540 | 4/1990 |
| DE | 42 15 151 | 11/1993 |
| DE | 199 60 742 | 6/2001 |
| DE | 100 06 015 | 8/2001 |
| DE | 101 00 173 | 7/2002 |
| EP | 1 072 762 | 1/2001 |
| EP | 1 167 705 | 1/2002 |
| FR | 2472 078 | 6/1981 |
| JP | 02 123215 | 5/1990 |
| JP | 07077020 | 3/1995 |
| JP | 2001132421 | 5/2001 |
| WO | WO 02 053881 | 11/2002 |

* cited by examiner

CONTROL DEVICE FOR A GAS EXCHANGE VALVE IN AN INTERNAL COMBUSTION ENGINE

CROSS REFERENCE TO RELATED APPLICATIONS

Applicants claim priority under 35 U.S.C. §119 of German Application No. 102 06 465.2 filed on Feb. 16, 2002. Applicants also claim priority under 35 U.S.C. §365 of PCT/DE03/00421 filed on Feb, 13, 2003. The international application under PCT article 21(2) was not published in English.

This invention relates to a control device for a gas exchange valve in an internal combustion engine according to the preamble of patent claim 1.

Such a control device is described in the older patent application WO 02/053881 A1.

This invention is concerned with the problem of creating a design of the generic control device in which an extremely high functional precision in operation of the control device can be achieved through simple manufacturing processes that can be handled economically.

This problem is solved by a control device having all the features of patent claim 1. According to this, all the essential parts of the control device are situated within a circular cylindrical recess, i.e., a circular cylindrical recess that covers 360 angular degrees.

Advantageous and expedient embodiments of this invention are the object of subclaims.

Accordingly, adjustment of the curve path of the curve joint, which is supported adjustably in the housing of the control device, can be accomplished by designing the curve path in a link element and adjusting this link element by means of a toothed gear for example.

A conventional camshaft, an eccentric drive or a positive control drive with complete forced guidance of the transmission element may be used as the driving elements.

Advantageous embodiments of this invention are illustrated in the drawing.

Figure 2:
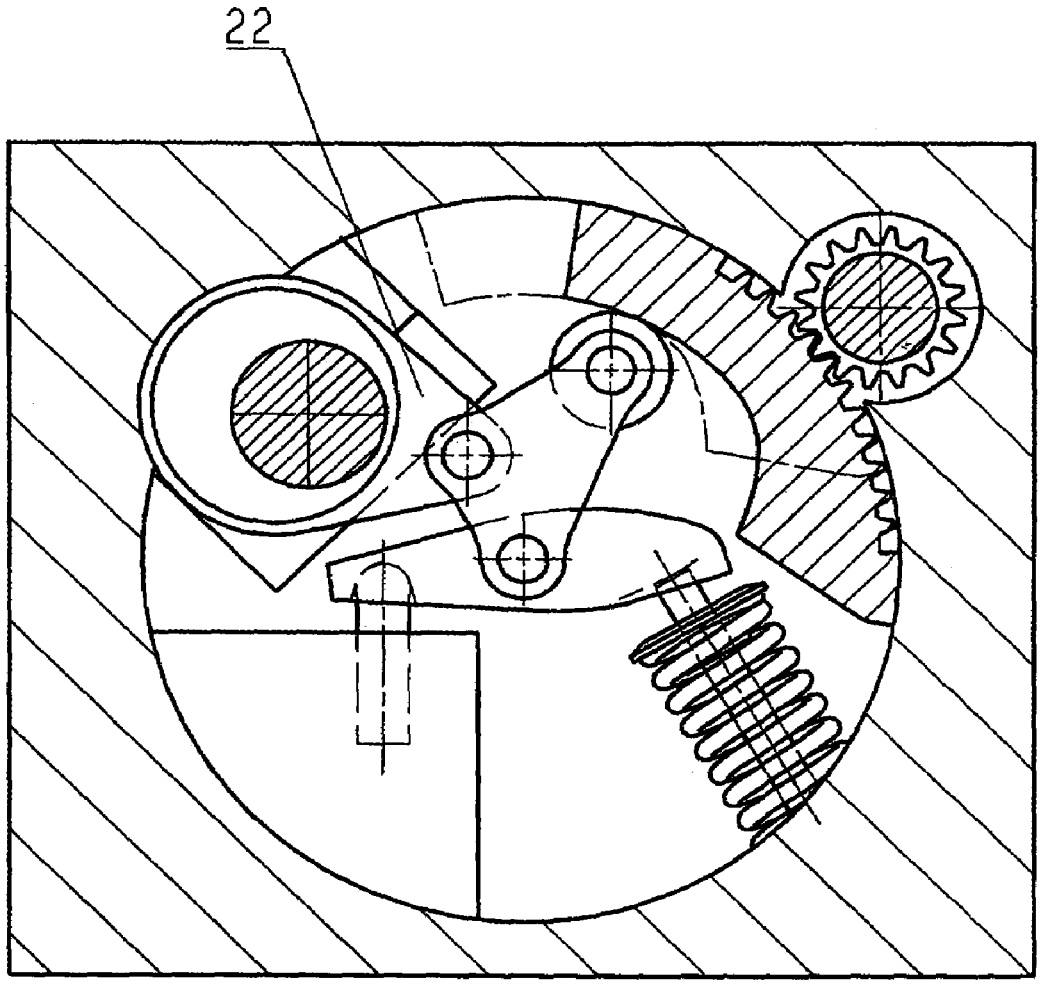
Figure 3:
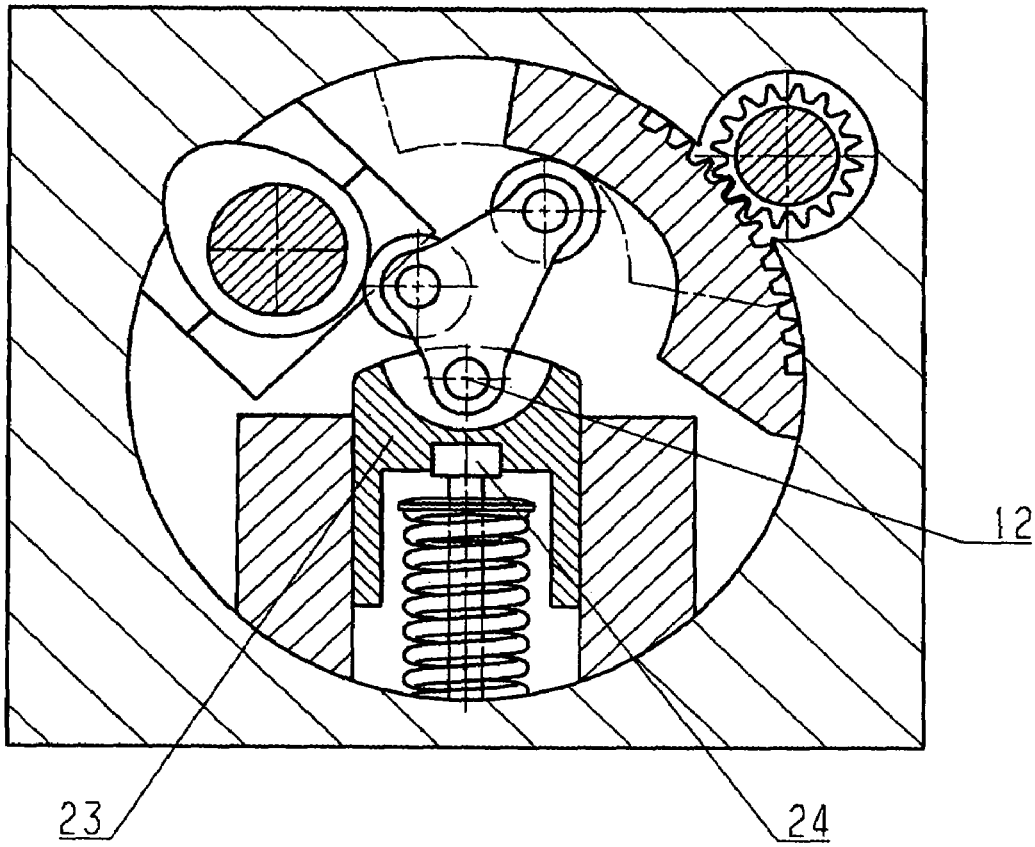

Schematic diagrams in the drawings show the following in the form of a view of a control device mounted in a circular cylindrical recess in a cylinder head:

FIG. 1 a control device having a conventional camshaft and a gas exchange valve operated by a swiveling lever, FIG. 2 a control device according to FIG. 1 in which the camshaft is replaced by an eccentric drive, FIG. 3 a control device having a conventional camshaft and cup tappet as the actuating element of a gas exchange valve instead of the swiveling lever according to FIG. 1.

The control device according to FIG. 1 operates with a conventional camshaft as the driving element and a swiveling lever 2 as the actuating element of a gas exchange valve 3. The entire control device is arranged inside of a circular cylindrical recess 4 in an area of a cylinder head designed in one piece.

Of the gas exchange valve 3, only the area which is connected directly to the swiveling lever 2 together with a valve spring 6 is shown.

The camshaft 1, which functions as a driving element is situated on the inside circular lateral cylindrical surface of the recess 4 via a divided bearing block 7.

A cam 8 driven by the camshaft 1 is connected to a transmission element 9 via a curve joint 10. Within the curve joint 10, a first roll 11, which is rotatably mounted on the transmission element 9, forms the bearing area of this curve joint 10 there. The transmission element 10 is connected via a rotating joint 12 to the swiveling lever 2. On its end, which is at a distance from the valve 3, this swiveling lever 2 is supported pivotably on a supporting element 13. This supporting element 13 is directly supported on the circular cylindrical inside circumference of the recess 4 with this cooperating bearing element 14 and can be combined with and/or interact with such a valve play equalizing device.

The axis of rotation of the rotating joint 12 of the swiveling lever 2 coincides with the axis of the circular cylindrical recess 4 when the gas exchange valve 3 is closed.

The transmission element 9 is connected via another curve joint 15 to the housing of the control device, i.e., to the cylinder head 5 here. On this housing and/or the cylinder head 5 on the circular lateral cylindrical surface of the recess 4, a link element 16 is displaceably mounted so that it can be displaced in the peripheral direction of the lateral cylindrical surface of the recess 4 with the curve joint area of the transmission element 9 acting on it.

The bearing area of the curve joint 15 of the transmission element 9 is designed as a second roll 17, which is rotatably mounted on the transmission element 9, while the bearing area on the link element 16 is designed as a curve path having a particular shape. The particular shape of the curve path consists of the fact that a first area 18 is provided, having a lateral surface which is concentric with the circular cylindrical inside lateral surface of the recess 4 and with a second valve stroke area 19 which is the deciding factor for the stroke of the gas exchange valve 3 being connected to it. The drawing shows the maximum possible displacement positions represented alternatively by a diagram in solid lines for a maximum stroke length of the respective gas exchange valve 3 and in broken lines for a minimum stroke, e.g., a zero stroke. The control device shown in FIG. 1 is intended for an internal combustion engine having multiple cylinders and it has a one-piece link element 16 for this purpose.

The assignment of the curve path to the first area 18 and the valve stroke 19 to the transmission element 9 is altered by displacement of the link element 16 in the peripheral direction of the lateral cylindrical surface of the recess 4. Therefore, different valve strokes can be adjusted between the two stroke limits described above.

For displacement of the link element 16 within the recess 4, a toothed gear may be used; in the simplest case, this is a pinion 20, which is rotatably mounted in the cylinder head 5 and engages in a toothed outside area 21 of the link element 16.

The supporting element 13 for the swiveling lever 2 may be combined and/or equipped with a conventional valve play equalizing device.

The control device described above functions as described below.

The camshaft 1 with the cam 8 as the driving element acts via the curve joint 10 on the transmission element 9, which is guided via the other curve joint 15 on the link element 16, which is adjustable within the cylinder head 5 and actuates the gas exchange valve 3 by means of the swiveling lever 2, which is additionally hinge-connected to the transmission element 9. The valve stroke depends on the set position of the link element 16, but a valve stroke can be produced in only one position of the link element 16 in which the curve joint 15 operates effectively within the valve stroke range 19 of the link element 16.

A spring (not shown) may act on the transmission element 9 for spring-loaded contact of the transmission element 9 with the camshaft 1 and the link element 16.

It is also conceivable for a slight play to be set through appropriate stops for the transmission element 9 between the basic circular area of the cam 8 of the camshaft 1 and the first roll 11 on the transmission element 9 in order to reduce frictional losses by the system. In this case, a restoring force by means of a spring, for example, is also necessary.

All the components of the control device which determine position, namely the bearing block 7 of the camshaft 1, the bearing element 14 of the supporting element 13 and the link element 16 with the curve path of the curve joint 15 situated on it are directly aligned with and mounted in the cylindrical inside surface of the recess 4, which is provided in the cylinder head. In particular, the link element 15 is a component which is mounted in an essentially stable and a deformation-free manner in the cylinder head. The area of the cylinder head 5 which is shown as being in one piece may also be designed to be divided for simpler assembly of the control device. It may also be adequate for the recess 4 not to be closed over the entire circumference, i.e., the advantages according to this invention can also be achieved with only a circular cylindrical recess limited to less than 360° of the circumference.

The embodiment according to FIG. 2 differs from that according to FIG. 1 only in that instead of a conventional camshaft 1 an eccentric drive 22 is used. Therefore, only this component in FIG. 2 is labeled with the respective reference number, while all the other components are free of reference notation like those according to the embodiment in FIG. 1.

In the embodiment according to FIG. 3, the actuating element for the gas exchange valve 3 is not a swiveling lever 2 but instead is a tappet device 23, which is combined with a valve play equalizing device 24, among other things. The articulated connection of the tappet connecting device 23 to the transmission element 9 is accomplished in an access of rotation which corresponds to that of the swiveling lever 2 in FIG. 1. Inasmuch as no reference numbers are given for the individual components in FIG. 3, they are essentially the same as those given in FIG. 1.

The invention claimed is:

1. A control device for gas exchange valves (3) of an internal combustion engine having a multi-membered transmission, comprising at least one driving element (1, 22), actuating elements (2, 23) each of which actuates one gas exchange valve (3), a transmission element (9) which is hinge-connected between the at least one driving element (1, 22) and an actuating element (2, 23) acting on one gas exchange valve (3) each, a curve joint (15) between the transmission elements (9) and an area of a housing (5) of the control device, in which a first bearing area which is provided on the transmission element (9) and a second bearing area which is provided in the housing area are adjustable with respect to one another during operation of the engine, the second bearing area of the curve joint (15) of the transmission element (9), said bearing area being supported on the housing (5), is designed as an adjustable curve path which influences the path of movement of the transmission element (9) while the first bearing area, which is provided on the transmission element (9) cannot exert any variable movement of the respective transmission element, the second bearing area of the curve joint (15) is formed by the radial inside surface of an arc shaped element (16), the link element (16) is supported so that it is displaceable in the peripheral direction in a complementary guide surface of the housing of the control device, with a circular cylindrical peripheral surface that is on the outside radially, wherein the housing (5) of the control device is provided with a circular cylindrical recess (4), the inside circumference of which at least the driving element (1, 22), a supporting bearing (14) for the actuating elements (2,23) and the link element (16) are supported in a radially defined position.

2. The control device according to claim 1, wherein for displacement of the link element (16) in the direction of the circular arc, a toothed pinion (20) mounted in the housing (5) cooperates with gear teeth (21) provided in the link element (16).

3. The control device according to claim 1, wherein only one adjustable link element (16), which is designed in one piece is provided for actuation of a plurality of gas exchange valves (3) which are arranged in a row.

4. The control device according to claim 1, wherein the housing of the control device is an area of the cylinder head (5) of the combustion engine.

* * * * *